United States Patent [19]

Matkan

[11] Patent Number: 4,764,443

[45] Date of Patent: Aug. 16, 1988

[54] METHOD OF IMAGE REVERSAL IN COLOR ELECTROPHOTOGRAPHY

[75] Inventor: Josef Matkan, Malvern, Australia

[73] Assignee: Stork Research B.V., Boxmeer, Netherlands

[21] Appl. No.: 920,715

[22] Filed: Oct. 17, 1986

[30] Foreign Application Priority Data

Oct. 31, 1985 [AU] Australia ..... PH03190

[51] Int. Cl.[4] ..... G03G 13/01; G03G 13/22

[52] U.S. Cl. ..... 430/45; 430/47; 430/126

[58] Field of Search ..... 430/45, 47, 126

[56] References Cited

U.S. PATENT DOCUMENTS 2,972,304 2/1961 Jarvis ..... 430/126 X
3,166,420 1/1965 Clark ..... 430/126 X
3,888,664 6/1975 Carlson et al. ..... 430/126

FOREIGN PATENT DOCUMENTS 757789 4/1971 Belgium ..... 430/126

*Primary Examiner*—Roland E. Martin
*Attorney, Agent, or Firm*—Silverman, Cass, Singer & Winburn, Ltd.

[57] ABSTRACT

An electrophotographic method of producing positive color proof copies from negative films wherein a charged photoconductor is exposed to the negative film and toned with a conductive toner forming image deposits in the unexposed area. The conductive deposits are transferred to a dielectric paper and affixed thereto. The dielectric paper is charged, the charge being accepted only in areas free of the conductive deposits, i.e. the final image areas. The charged areas are toned with color toners and the color toner deposit transferred to printing stock to provide the positive proof.

10 Claims, 2 Drawing Sheets

METHOD OF IMAGE REVERSAL IN COLOR ELECTROPHOTOGRAPHY

BACKGROUND OF THE INVENTION

This invention relates to electrophotography and in particular to a novel method of preparing by an electrophotographic process multicolor pre-press proofs from negative color separation films.

The purpose of pre-press proofs as is well known in the art is to assess color balance and strength which can be expected from the final press run and accordingly to correct the separation transparencies before the printing plates are made therefrom. In many instances it is also required to produce so-called customer proofs for approval of subject, composition and general appearance of the print prior to press run. Thus it is essential that the pre-press proof should have the same appearance as the press print, that is to say in addition to matching the colors of the press print, the pre-press proof should be of the same paper as the press print.

On the basis of the pre-press proofs the color separation transparencies are accepted or corrected if found necessary and then used for the preparation of printing plates. There are so-called positive working and negative working printing plates, as is well known in the art. A positive working printing plate is exposed to a positive transparency or film positive wherein the information to be printed corresponds directly to opaque areas whereas the non-printing background areas correspond to transparent areas contained on such film positive. By exposing to light through a film positive working plate the exposed areas contained thereon are rendered removable by chemical treatment and the underlying usually grained aluminum plate surface forms then the water receptive non-printing or non-image areas whereas the unexposed areas contained thereon form the ink receptive printing or image areas during the subsequent lithographic or offset printing. A negative working printing plate is exposed to light through a film negative wherein the information to be printed corresponds to transparent areas whereas the non-printing background areas correspond to opaque areas contained on such film negative. In this case the exposed areas become photo-hardened and form the ink receptive printing areas whereas the unexposed areas are removed by chemical treatment and the underlying water receptive usually grained aluminum plate surface forms the non-printing or non-image areas during subsequent lithographic or offset printing. It is known to produce by electrophotographic processes lithographic and gravure prepress proofs containing in general four colors, such as yellow, magenta, cyan and black. Such prepress proofing processes are disclosed for instance in U.S. Pat. Nos. 3,337,340; 3,419,411; and 3,862,848.

It is customary to produce such electrophotographic pre-press proofs by charging a photoconductive recording member followed by exposure through a separation film positive corresponding to one color, followed by toning of the exposed photoconductor with a liquid dispersed toner of the appropriate color, followed by in-register transfer of the color toned image deposit to a receiving member surface, such as paper, usually of the same grade as the printing stock. These process steps are then repeated with separation film positives of the other three or more colors and appropriate color toners to produce a multicolor pre-press proof or print as required.

It should be noted that all prior art electrophotographic pre-press proofing processes are so-called direct reproduction processes that is to say the color separation transparencies employed comprise film positives wherein the image areas to be reproduced correspond directly to the opaque image areas on such film positives. Consequently in such prior art electrophotographic pre-press proofing processes the latent image formed on the photoconductor upon exposure to such positive separation films is developed by attracting thereto liquid toner material of opposite polarity to that of the electrostatic charges constituting said latent images whereby the so formed toner deposits on the photoconductor surface correspond directly to the image areas to be reproduced. Thus prior art electrophotographic pre-press proofing processes are employed only for proofing of film positives which are used for the preparation of positive working printing plates.

Prior art electrophotographic pre-press proofing processes are not suitable for the proofing of film negatives used for the preparation of negative working printing plates that is to say such processes are not suitable for the reversal reproduction of imagery wherein the transparent areas contained on a film negative are to be reproduced as the image areas on the pre-press proof. Reversal reproduction per se by electrophotography is well known in the art but the processes employed for this purpose are not suitable for multicolor pre-press proofing.

Reversal image reproduction in electrophotography is normally carried out according to prior practices by means of so-called repulsion toning. This process comprises the steps of electrostatically charging the surface of a photoconductor to a polarity, typically charging an n-type photoconductor such as zinc oxide to negative polarity, exposing said surface to a film negative containing the image to be reproduced in the form of transparent areas and the non-image part in the form of opaque areas whereby the photoconductor surface becomes discharged in the exposed image areas whilst retaining the charge in the unexposed non-image areas and applying to said surface toner material having the same polarity as that of the charges contained on said surface, typically applying negative toner material to a negatively charged n-type photoconductor surface, whereby such toner material is repelled from the charged non-image areas onto the discharged image areas forming toner deposits thereon corresponding to the image to be reproduced. The thus formed image deposits in certain instances are fused to the photoconductor surface whereas in other instances they are transferred to a receptor sheet.

Such above described image reversal reproduction by electrophotography is very well suited to microfilm and microfiche reproduction and reader/printers where the information to be reproduced generally is in the form of alphanumeric characters and the lines where complete fill-in of large solid areas and complete absence of fog or stain in the non-image areas are not absolutely required. In prepress proofing however in order to match the image quality of the press printed sheet it is essential to have on the pre-press proof large solid areas completely filled in and background areas completely free of fog or stain. These requirements cannot be met by the prior art electrophotographic reversal process, because unlike by attraction toning, by repulsion toning it is not possible to produce uniformly filled in large solid areas in that toner repulsion from charged background areas onto uncharged solid image areas is most effective near the edges of the solid area where the intensity of the field lines from the charged background area terminating in the uncharged image area is highest and it diminishes in effectiveness towards the center of the solid image area wherein the intensity of the terminating field lines is lowest. This results in solid image areas characterized by high density near the edges and so-called hollow or lower density center. For the same reason in repulsion toning the background or non-image areas are completely free of fog or stain only near the edges. This so-called edge effect cannot be fully overcome even by using biasing means during repulsion toning, that is by placing a so-called developing electrode a short distance apart from the photoconductor surface to thereby enhance toner deposition as is well known in the art.

SUMMARY OF THE INVENTION

In accordance with the present invention a multicolor print or pre-press proof is prepared from negative film color separations in essense by uniformly charging a photoconductor to a first polarity, exposing the photoconductor to light through the negative film separation of the first color to thereby discharge the photoconductor in the image areas which are ultimately to be reproduced and which image areas correspond to the transparent areas of the film negative, while retaining the charges on the photoconductor in non-image areas corresponding to the opaque areas on said film negative, applying to the photoconductor conductive toner of second or opposite polarity to form conductive toner deposits by attraction development in the non-image areas thereon, transferring such conductive toner deposits onto a dielectric member and affixing same thereto, charging the dielectric member to a polarity whereby only the charge accepting areas thereof free of said conductive toner deposits become charged, applying to said dielectric member first color toner material having opposite polarity to that of the charges on the dielectric member to form by attraction development first color toner deposits thereon in said charged areas, transferring said first color toner deposits onto a receptor member such as printing stock paper to form thereon image deposits corresponding to those ultimately to be printed, repeating the process steps as outlined for the second, third, fourth and any further colors if so desired and affixing the transferred color toner deposits onto said receptor member.

It should be noted that in accordance with the above described image reversal method of this invention, in both instances of toning electrostatic latent images, that is first toning the photoconductor with conductive toner and second toning the dielectric member with color toner, image formation is by attraction development in that in both instances the toners are of opposite polarity to that of the charges forming the latent image; so that prints or prepress proofs produced in accordance with this invention are characterized by having very uniformly filled-in solid areas and completely clean background or image free areas.

DESCRIPTION OF A PREFERRED EMBODIMENT

Figure 1:
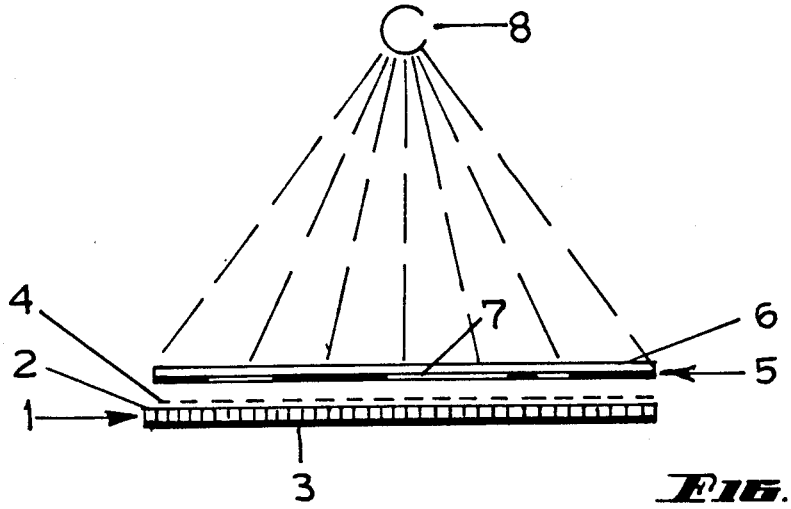
FIG. 1 is a diagrammatic representation of a photoconductive recording member illustrating the contact exposure of a charged photoconductive member in accordance with the method of the invention.

In FIG. 1 there is illustrated a photoconductive recording member 1 comprising a photoconductive layer 2 on a conductive support 3, uniformly charged to negative polarity as indicated by the negative charges 4. A film negative separation of the first color 5 containing opaque final background or non-image areas 6 and transparent final image areas 7 is placed in contact with photoconductive recording member 1 for contact exposure through light source 8.

Figure 2:
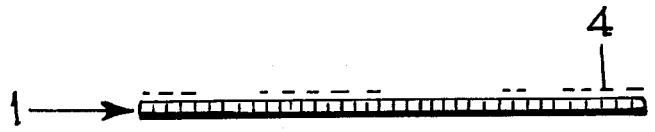
FIG. 2 is a representation of the photoconductive member of FIG. 1 after exposure.

In FIG. 2 is shown the photoconductive recording member 1 after exposure, having retained negative electrostatic charges 4 only in the areas corresponding to the final background or non-image areas 6 of negative film separation 5 of FIG. 1.

Figure 3:
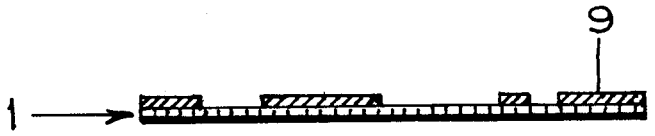
FIG. 3 is a diagrammatic representation of the photoconductive member of FIG. 2 illustrated subsequent to toning with a conductive toner.

The photoconductive recording member 1 then is toned with a conductive positive toner which is attracted to the remaining electrostatic charges thereon and forms conductive toner deposits 9 as shown in FIG. 3.

Figure 4:
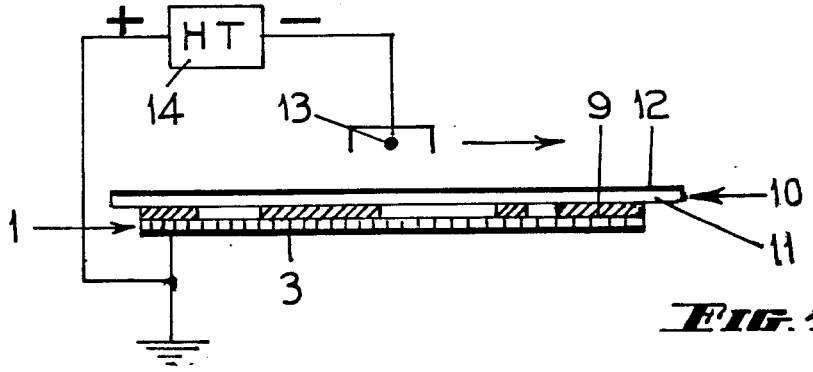
FIG. 4 is a diagrammatic representation illustrating the electrostatic transfer of the conductive toner image onto a dielectric member in accordance with the method of the invention.

In FIG. 4 is shown where such conductive toner deposits 9 are electrostatically transferred from photoconductive recording member 1 onto a dielectric member 10 comprising an insulative or dielectric layer 11 on a relatively conductive support 12. Transfer is effected by placing the insulative surface 11 of dielectric member 10 in virtual contact with the image bearing photoconductor 2 of photoconductive recording member 1, grounding the conductive support 3 thereof and passing a corona generator 13 over the thus formed sandwich. Corona generator 13 is fed by the negative terminal of power supply 14, the positive terminal of same being grounded.

Figure 5:
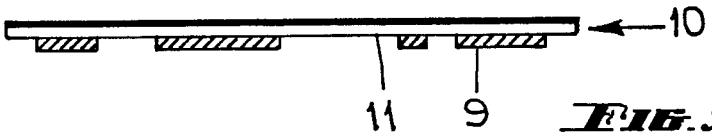
FIG. 5 is a representation of the dielectric member of FIG. 4 carrying the conductive toner image after same has been affixed thereto.

In FIG. 5 is shown dielectric member 10 containing on its insulative or dielectric surface 11 transferred conductive toner deposits 9 which have been affixed thereon by means not shown, but preferably by heating.

Figure 6:
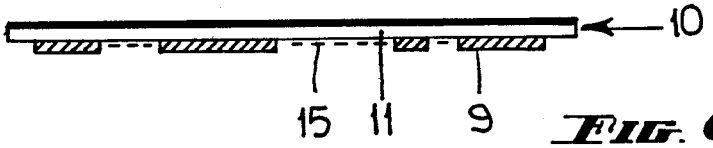
FIG. 6 is a representation of the dielectric member of FIG. 5 illustrated as carrying a negative charge at areas not covered by the conductive toner.

In FIG. 6 is shown dielectric member 10, containing on its insulative or dielectric surface 11 affixed conductive toner deposits 9, after having been uniformly charged electrostatically by means not shown to negative polarity. It will be seen that negative charges 15 are supported by the insulative or dielectric surfaces 11 of dielectric member 10 only in those areas which are free of conductive toner deposits 9, that is to say in areas corresponding to the final image areas.

Figure 7:
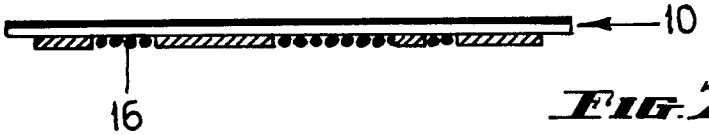
FIG. 7 is a representation of the charged dielectric member of FIG. 6, same carrying toner deposits of the first color toner.

The thus charged dielectric member 10 then is toned with a positive toner of the first color which is attracted to the negative charges 15 thereon of FIG. 6 and forms first color toner deposits 16 as shown in FIG. 7.

Figure 8:
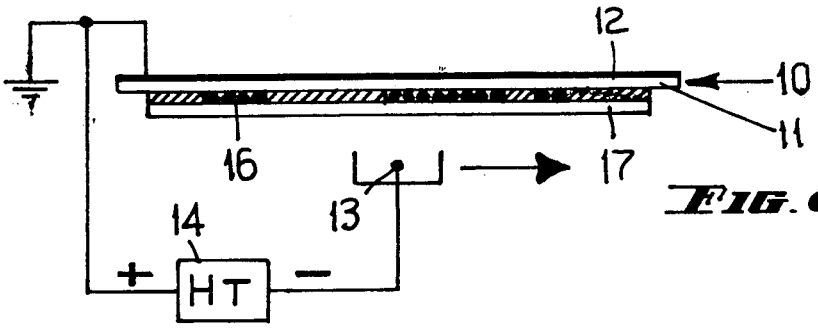
FIG. 8 is a diagrammatic representation of a device for electrostatically transferring the first color deposits from the dielectric member of FIG. 7 to an image or print receptor.

In FIG. 8 is shown where such first color toner deposits 16 are electrostatically transferred from dielectric member 10 onto a receiving member such as printing stock paper 17. Transfer is effected by placing the stock paper 17 in virtual contact with the image bearing dielectric surface 11 of dielectric member 10, grounding the relatively conductive support 12 thereof and passing corona generator 13 over the thus formed sandwich. Corona generator 13 is fed by the negative terminal of power supply 14, the positive terminal of same being grounded.

Figure 9:
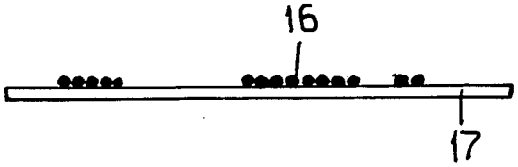
FIG. 9 is a representation of the image or print receptor carrying the transferred first color toner deposits.

In FIG. 9 is shown the printing stock paper 17 containing the transferred first color toner deposits 16 thereon. It will be seen that such deposits 16 are contained in areas corresponding to the final image areas to be printed which are shown in FIG. 1 as the transparent areas 7 of first color negative film separation 5.

To produce a multicolor print or pre-press proof in accordance with this invention the above disclosed steps are repeated in succession with negative film separations of subsequent colors and corresponding color toners. For each color a separate dielectric member is produced and the color toner deposits are transferred therefrom in succession onto the same receiving member or printing stock to produce a multicolor image thereon. As in a multicolor print or prepress proof all colors have to be in precise relation to each other, for this purpose the negative film color separations are placed in register with the photoconductive recording member during contact exposure, the dielectric members are placed in register with the photoconductive member for transfer of the conductive toner deposits and the receptor sheet is placed successively in register with each dielectric member for transfer of successive color toner deposits.

It should be noted that depending on the type of the relatively conductive support and insulative coating, the dielectric member may be reused, that is to say it is possible to produce with for instance one four color set of dielectric members a multiplicity of prints or prepress proofs. In such case a dielectric member is prepared following the above disclosed procedure from each color separation film negative, following which the dielectric member for the first color is charged, toned with the first color toner to form deposits thereon which are then transferred to a receiving sheet or printing stock or proof paper, these steps being then repeated until the desired number of proofs is obtained. The same procedure is then followed with the dielectric members for the second, third and fourth colors, and the appropriate color deposits formed thereon are successively transferred onto receiving members having the preceding color deposits already transferred thereon until the desired number of four color proofs is produced. This is a very considerable time saving aspect of this invention because a multiplicity of proofs can be rapidly produced from reusable dielectric members by only once carrying out the steps of handling the film negatives and the photoconductive recording member, toning with conductive toner, transferring conductive toner deposits onto dielectric members and fusing same thereon.

It should be noted that for illustrative purposes in the foregoing reference was made to charging the photoconductive member to negative polarity, that is to the use of an n-type photoconductor, followed by toning same by attractioon thereto of positive conductive toner, however it is equally possible to employ a p-type photoconductor which can be charged positively and toned by attraction thereto of negative conductive toner. In like manner the dielectric member can be charged positively and toned by attraction thereto of negative color toners if found advantageous. It will be realized of course that in those instances where a negative conductive toner is transferred from the photoconductive member onto the dielectric member and/or a negative color toner deposit is transferred from the dielectric member onto the receiving member, the polarity of the transfer corona generator will be positive and grounding polarity will be negative.

It should be further noted that in the foregoing electrostatic transfer has been illustrated by means of a corona generator, however it is possible to employ other means of electrostatic transfer such as for instance replacing the corona generator by a traversing roller comprising a conductive core connected to the terminal of the power supply and a cover layer of semiconductive elastomer, as is well known in the art. Furthermore, transfer of color toner deposits from the dielectric members onto the receiving member may be effected by methods other than electrostatic, such as for instance by pressure, adhesion, heat and/or embedment in a receptor coating on the receving member.

An important feature of this invention is the conductive toner which forms conductive deposits on the dielectric member whereby the dielectric layer can be charged electrostatically in those areas only which are free of said conductive toner deposits. The requirements for such toner are that it should be transferrable from the photoconductor to the dielectric member, that the transferred deposits should be affixable thereto to a degree where they are not affected by toning the dielectric member with color toners and do not transfer to any extent whatsoever therewith when the color toner deposits are transferred from the dielectric member onto the receiving member, that the affixed toner deposits contain no discontinuities therein which may accept charge and consequently color toner deposition resulting in fog or stain on the receiving member in background or non-image areas thereof and that they should be sufficiently conductive so as to prevent charge acceptance by the dielectric member except in those areas which are free of such conductive deposits. It should be noted however that some charge acceptance by the conductive deposits can be admissible provided the charge level on such conductive deposits is not higher than 10% to 30% of the charge level on the dielectric surface, in which case during toning with color toners reverse biasing means as well known in the art can be employed to prevent toner deposition onto areas containing charges below a certain level. It is also possible to prevent charge acceptance by such conductive toner deposits by incorporating therein semiconductive or photoconductive substances such as for instance an n-type photoconductive zinc oxide which would prevent such deposits accepting a positive charge and/or which would render such deposits conductive and thus prevent charge acceptance of any polarity when exposed to light during the step of uniformly charging the dielectric member preparatory to toning with color toner.

Conductive toners for the purposes of this invention contain in essence a fixable binder in which is dispersed a conductive pigment. Such conductive toners can be readily formulated by those skilled in the art of toner making by utilizing binders or polymeric materials which upon fusion or fixation to the dielectric surface effectively prevent unwanted transfer of the conductive deposit to the receiving member during transfer of the color toner deposit. Such fixation may be effected by thermal or other electromagnetic radiations, or chemical or solvent action upon the polymeric component of the conductive toner deposit. Such binders or polymeric materials should be substantially insoluble in the carrier liquid selected for the conductive toner so that said binder or polymeric material will co-deposit with the conductive component of the toner composition. Included in materials capable of being utilized in such conductive toner as binders are epoxies, phenoxies, polyesters; acrylates, methacrylates and copolymers thereof; polyvinyl chloride, polyvinyl acetate and copolymers thereof; ketone formaldehyde condensates; waxes, both synthetic and naturally occurring; polystyrene, polybutadiene, polyvinyl toluene, polyvinyl acrylate and copolymers thereof; acetal and butyral polymers; rubbers, natural, synthetic and cyclized. Conductive pigments may comprise for instance metal powders such as aluminium, brass, zinc, iron or the like, or conductive carbon blacks, such as Vulcan XC 72 made by Cabot Inc. or Conductex SC made by Columbian Carbon Black Corp. Alternatively, a photoconductive pigment, such as zinc oxide Photox 801, made by New Jersy Zinc Co., may be used if desired, in which case the toner deposit becomes conductive upon illumination by light. The proportion by weight of binder to conductive pigment may range from 0.5 parts to 10 parts of binder to 1.0 part of conductive pigment, the preferred range being 1.0 to 3.0 parts of binder to 1.0 part of conductive pigment.

The dielectric members usable in accordance with this invention may comprise commercially available dielectric papers, such as made by Scott Graphics International, Belgium, or Minolta Camera Co., Japan, for Minolta EG1O1 photocopier or as supplied by Versatec Inc. California, for Versatec printer plotters.

Color toners usable in the process of the present invention may be for example as disclosed in U.S. Pat. No. 3,998,746 of Tsuneda, U.S. Pat. No. 3,820,986 of Fukashima et al., and U.S. Pat. No. 3,419,411 of Wright.

There has been described a novel electrostatographic method of reversal reproduction that is of producing positive imagery from film negatives. The method employs attraction development throughout with liquid toners, hence image quality is excellent, and the method is particularly suitabale for the production of multicolor pre-press proofs on printing stock. An additional feature of the method consists in the provision of making a multiplicity of multicolor pre-press proofs from the same subject matter in rapid succession by omitting certain process steps necessary for the preparation of the first multicolor pre-press proof or print. Equipment configuration, materials and proportioning of materials as disclosed herein are intended to be construed in illustrative sense only without restricting the scope of this invention.

What is claimed is:

1. A method of electrostatographic image reversal wherein a positive print comprising a receptor sheet having image-free areas and image area formed by colored toner deposits is produced from a negative film having opaque areas corresponding to said image-free areas on said print and transparent areas corresponding to said image areas on said print, said method comprising the steps of:

A. electrostatically charging a photoconductor to deposit thereon uniformly charges of first polarity;

B. exposing said photoconductor to light through a negative film to thereby discharge said photoconductor in the areas corresponding to said transparent areas of said negative film while retaining said charges thereon in areas corresponding to said opaque areas of said negative film;

C. applying conductive toner material of second polarity to said photoconductor to form conductive toner deposits by attraction to said charges of first polarity retained thereon;

D. transferring said conductive toner deposits onto a dielectric member, said dielectric member provided with an insulative surface layer located on a relatively conductive support;

E. affixing said conductive toner deposits to said dielectric member insulative layer, wherein the conductivity of said affixed toner deposits is adapted to be adequate to prevent substantial charge acceptance by said conductive toner deposits;

F. electrostatically charging said dielectric member to uniformly deposit charges of a polarity substantially only in the areas free of said conductive toner deposits thereon;

G. applying to said dielectric member colored toner material of opposite polarity to that of said charges on said dielectric member to form colored toner deposites by attraction to said charges to areas free of said conductive toner deposits thereon;

H. transferring said colored toner deposits onto a receptor sheet; and

I. affixing said color toner deposits to said receptor sheet.

2. The method of electrostatographic image reversal according to claim 1, wherein plural negative separation films of subsequent colors and appropriate color toners are used sequentially to produce a multicolor print comprising said receptor sheet having image-free areas and image areas formed by multiple color toner deposits in register with each other, the steps of transferring said conductive toner and said color toner deposits respectively being effected in register and the color toner deposits are affixed to said receptor sheet subsequent to the last to be applied deposit the steps A-H being repeated with said color separation films and the appropriate color toners.

3. The method of electrostatographic image reversal according to claims 1 or 2, wherein said conductive toner deposits are affixed to said dielectric member by the application of heat.

4. The method of electrostatographic image reversal according to claims 1 or 2, wherein said conductive toner deposits are affixed to said dielectric member by at least partial solvation of polymeric material contained in said conductive toner deposits.

5. The method of electrostatographic image reversal according to claims 1 or 2, wherein the conductivity of said toner deposits affixed to said dielectric member adequate to prevent charge acceptance by said conductive toner deposits in excess of 30 percent of the charge acceptance of said dieleotric member in the areas free of said conductive toner deposits thereon.

6. The method of electrostatographic image reversal according to claims 1 or 2, wherein said color toner material is applied to said dielectric member employing biasing means held at a potential of the same polarity as the polarity of said charges in areas free of said conductive toner deposits on said dielectric member and on said conductive toner deposits thereon, the level of charges on said conductive toner deposits being substantially lower than the level of said charges in areas free of said conductive toner deposits on said dielectric member.

7. The method of electrostatographic image reversal according to claims 1 or 2, wherein said color toner material is applied to said dielectric member employing biasing means held at a potential of the same polarity as the polarity of said charges in areas free of said conductive toner deposits on said dielectric member and on said conductive toner deposits thereon, the level of charges on said conductive toner deposits being substantially lower than the level of said charges in areas free of said conductive toner deposits on said dielectric member, the level of said potential on said biasing means approximating the charge level on said conductive toner deposits on said dielectric member to thereby prevent attraction of color toner material to said conductive toner deposits while allowing attraction of color toner material to form color toner deposits on said dielectric member in areas free of said conductive toner deposits thereon.

8. The method of electrostatographic image reversal according to claims 1 or 2, wherein said colored toner deposits are transferred from said dielectric member onto said receptor sheet electrostatically.

9. The method of electrostatographic image reversal according to claim 1, wherein said steps of charging said dielectric member containing said conductive toner deposits affixed thereto, applying colored toner material thereto to form colored toner deposits thereon in areas free of said conductive toner deposits and transferring said colored toner deposits onto said receptor sheet are repeated and wherein said colored toner deposits are transferred onto successive receptor sheets to thereby produce a multiplicity of prints from a single dielectric member.

10. The method of electrostatographic image reversal according to claim 2, wherein said steps of charging said dielectric members containing said conductive toner deposits affixed thereto, applying appropriate color toner material thereto to form color toner deposits thereon in areas free of said conductive toner deposits and transferring said color toner deposits onto said receptor sheets are repeated and wherein said color toner deposits are transferred onto successive receptor sheets to thereby produce a multiplicity of multicolor prints from said dielectric members.

* * * * *